United States Patent [19]

Parker

[11] Patent Number: 4,496,617

[45] Date of Patent: Jan. 29, 1985

[54] ADHESIVE BINDING STRIP

[76] Inventor: Kevin P. Parker, 2015 Del Norte St., Berkeley, Calif. 94707

[21] Appl. No.: 499,914

[22] Filed: Jun. 1, 1983

[51] Int. Cl.[3] ..... B42D 1/00

[52] U.S. Cl. ..... 428/55; 156/908; 281/21 R; 428/195

[58] Field of Search ..... 156/291, 908; 428/195, 428/198, 55, 78; 281/21 R, 29

[56] References Cited

U.S. PATENT DOCUMENTS

| | | | |
|---|---|---|---|
| 798,313 | 8/1905 | Alexander | 428/198 |
| 2,294,347 | 8/1942 | Bauer et al. | 428/198 X |
| 3,531,358 | 9/1970 | Rost et al. | 156/475 |
| 3,847,718 | 11/1974 | Watson | 428/41 X |

*Primary Examiner*—Henry F. Epstein

*Attorney, Agent, or Firm*—Limbach, Limbach & Sutton

[57] ABSTRACT

A binding strip for binding a stack of sheets together in a book-like fashion. The binder strip includes an elongated substrate made of a formable material such as a strip of heavy paper. A relatively wide band of heat-activated adhesive extends down the center of the substrate. Two relatively narrow bands of heat-activated adhesive are disposed on opposite sides of the central adhesive band. The central adhesive band, which has a low viscosity at the application temperature, serves to bind the edges of the sheets together and to the substrate. The side adhesive bands, which are at least one-half as thick as the central adhesive band and which have a high viscosity at the application temperature, functions to secure the first and last sheets of the stack to the substrate. The first and last sheets serve as the cover sheets of the bound volume. The side adhesive bands also function to contain the low viscosity central adhesive during the binding process. It is preferred that the side adhesive bands be spaced apart from the longitudinal edges of the substrate a minimum amount so as to form a pair of edge gaps. These gaps increase the gripping strength of the molten side adhesive bands during the binding process.

10 Claims, 11 Drawing Figures

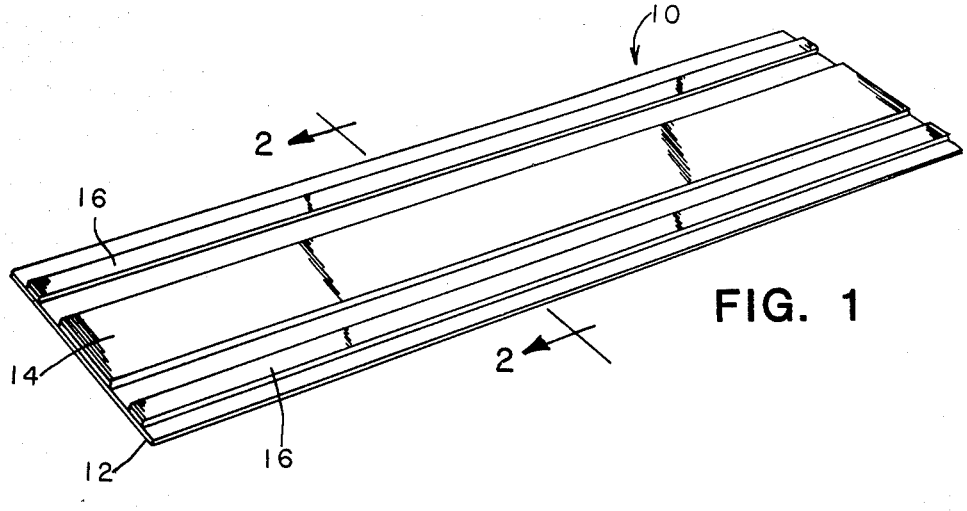
FIG. 1
FIG. 2
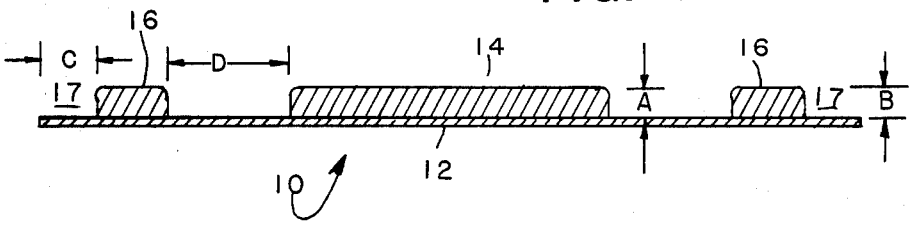
FIG. 4
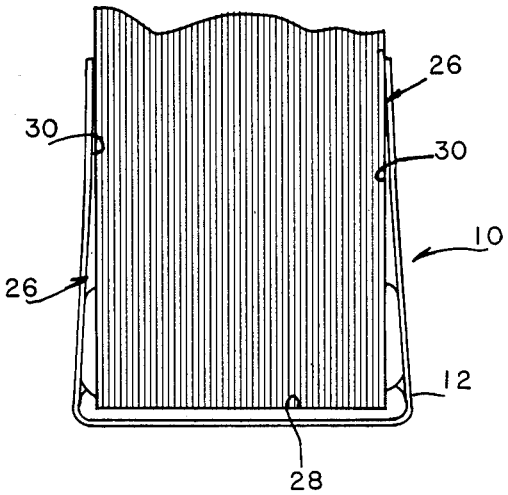

ADHESIVE BINDING STRIP

BACKGROUND OF THE INVENTION

1. Field of the Invention

The present invention relates generally to the field of devices for binding sheets of paper together and more particularly to an adhesive-backed binding strip for binding individual sheets or pages together in a book-like fashion.

2. Background Art

There are several well known techniques for binding pages together which do not require stitching as required in conventional book binding. For example, General Binding Corporation of Northbrook, Ill. markets a binding system under the trademark "Therm-A-Bind." The binding system includes a sheet of heavy paper stock which is folded upon itself to form the front and back covers of the bound volume. The central portion of the sheet is provided with three narrow bands of hot melt (heat-activated) adhesive. The pages to be bound are first stacked with an edge of the stack being positioned adjacent the adhesive bands. The cover is then folded around the pages and inserted in a binding machine which is provided with apparatus for melting the adhesive. The assembly is removed from the binding machine with the pages bonded to the cover sheet when the adhesive is cooled.

The primary disadvantage of the above-described binding system is that the cover sheets are an integral part of the system. Thus, there is no flexibility in the selection of cover sheets. In addition, the cost of the system is greatly increased by the inclusion of the cover sheets.

As a further example, U.S. Pat. No. 3,531,358 to Rost et al. discloses a binding apparatus which includes a strip of formable material coated with a layer of heat-activated adhesive. The individual pages to be bound are assembled together and packed so as to form a stack. The length of the strip is equal to the length of the edge of the stack to be bound with the strip width being somewhat greater than the stack thickness. The strip is positioned adjacent the stack edge and heat is applied causing the adhesive to become molten. The molten adhesive causes the edges of the sheets to be bound together upon cooling. Next, the edges of the strip are folded over the top and bottom sheets of the stack. Heat is then applied to the strip edges, thereby resulting in an adhesive bond between the strip and the top and bottom sheets (cover sheets) of the stack when the adhesive cools.

One shortcoming of the Rost et al. apparatus is that a single type of adhesive is used to perform two disparate functions. It is preferable that the adhesive adjacent the edge of the stack be of a relatively low viscosity when molten so that the adhesive is drawn up between the pages a significant distance. It is also preferable that the adhesive on the edges of the strip which bond the strip to the cover sheets be of a relatively high viscosity when molten so that the adhesive does not run out the edges of the strip onto the cover sheets. Thus, single adhesive binding apparatus of the type disclosed by Rost et al. is a compromise and is incapable of optimally performing both functions.

U.S. Pat. No. 3,847,718 to Watson discloses a dual adhesive binding strip which overcomes some of the previously-noted shortcomings of the Rost et al.-type apparatus. The Watson strip is provided with a relatively thick longitudinal central band of heat-activated adhesive which is flanked by two relatively thin longitudinal bands of adhesive flanking the central band. The central adhesive band is said to be of the low tack variety with the side bands being of the high tack variety.

Although the Watson dual adhesive strip is an improvement over the single adhesive Rost et al. device in some respects, the dual adhesive strip does possess certain disadvantages. By way of example, a ridge is sometimes formed at the two junctures of the relatively thick and thin adhesive bands which detracts from the appearance of the bound volume. The ridge is especially pronounced when the bound pages are substantially thinner than the width of the central adhesive band. Perhaps more importantly, it appears that the adhesive used in the central band of the Watson strip must possess a viscosity in the thermoplastic state which is higher than the optimum viscosity. As previously noted, it is preferable that the adhesive applied to the edges of the pages have a very low viscosity at the application temperature so that the adhesive will be drawn up between the pages. Preliminary tests indicate that if an optimum low viscosity central adhesive is used on a Watson-type strip, the adhesive sometimes has a tendency to flow over the relatively thin bands of high tack adhesive flanking the central band. The presence of the low tack adhesive on the bands of high tack adhesive greatly reduces the strength of the bond to the cover sheets.

The present invention overcomes the above-noted disadvantages of the prior art devices. The disclosed binder strip utilizes two adhesives, one optimized for bonding the edges of the pages to one another and to the substrate and the other optimized for bonding the substrate to the cover sheets. Very low viscosity adhesive can be used for the central adhesive without interfering with the bond between the substrate and the cover sheets. In addition, the bound volume is devoid of unsightly ridges, even when the thickness of the bound pages is substantially less than the width of the central adhesive band. These and other advantages of the subject invention will become apparent upon a reading of the following detailed description of the invention together with the drawings.

SUMMARY OF THE INVENTION

A binding strip for binding a stack of sheets together in a book-like fashion is disclosed. The binding strip includes an elongated substrate made of a formable material such as heavy paper. A band or stripe of heat-activated adhesive is disposed on the substrate along the longitudinal axis of the substrate. Two additional bands or stripes of heat-adhesive are disposed on the substrate on opposite sides of the central band.

The central adhesive band of the subject binder strip, which is comprised of a low viscosity adhesive, serves to bind the edges of the sheets together and to the substrate. The two outer adhesive bands are comprised of a high viscosity adhesive. The outer adhesive bands should be at least half as thick as the central adhesive band. These bands serve to secure the first and last sheets of the stack which form the covers of the final volume to the substrate. The outer bands further serve to contain the molten low viscosity adhesive of the central band during the binding process.

BRIEF DESCRIPTION OF THE DRAWINGS

FIG. 1 is a perspective view of an exemplary embodiment of the subject binder strip.

FIG. 2 is a cross-sectional view of the subject binder strip taken through section line 2—2 of FIG. 1.

FIG. 4 is an enlarged view of a section of a bound volume showing some of the details of the subject binder strip after binding.

DETAILED DESCRIPTION OF THE INVENTION

Figure 3A:
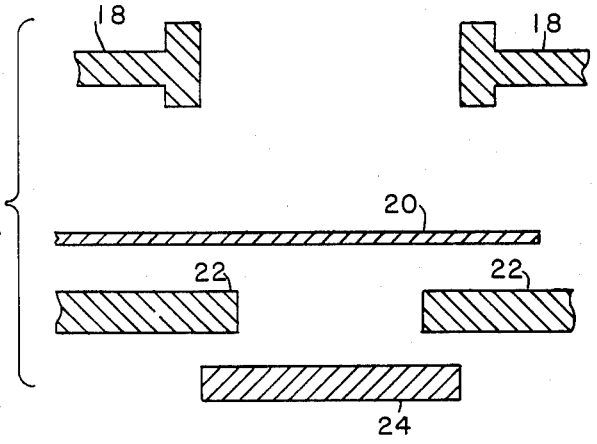
FIGS. 3A–3H are schematic representations depicting a typical sequence for binding a stack of paper sheets utilizing the disclosed binder strip.

Referring now to the drawings, an exemplary embodiment of the subject binding strip may be seen in FIGS. 1 and 2. The strip, generally designated by the numeral 10, includes an elongated substrate 12 made of a formable material. The binding strip further includes a longitudinal band of heat-activated adhesive 14 which extends down the central portion of the substrate. Central adhesive band 14 is flanked by a pair of relatively narrow bands 16 of heat-activated adhesive which extend along substantially the full length of substrate 12. Adhesive band 14 forms part of the spine of the bound volume and is sometimes referred to herein as the spine adhesive. Adhesive bands 16 secure the binding strip to the covers of the bound volume and are sometimes referred to herein as the cover adhesives.

Substrate 12 is preferably fabricated from a heavy paper stock. However, other formable materials which are compatible with the heat-activated adhesives and capable of resisting the application temperatures of the adhesives may also be used. The length of substrate 10 should be equal to or slightly less than the length of the edge of the sheet to be bound. However, the binder strip can be manufactured in roll form with the end user cutting the strip to the desired length. The width of substrate 10 is somewhat greater than the thickness of the stack of sheets to be bound. It is contemplated that the binder strips will be manufactured in varying widths, with the particular width used depending on the thickness of the stack of sheets to be bound.

Adhesive bands 14 and 16 consist of conventional heat-activated or hot melt adhesives which are generally solid at room temperature but which become molten or thermoplastic at elevated temperatures. Heat-activated adhesives, which are substantially free of solvents, form an adhesive bond upon cooling although some such adhesives may be somewhat tacky at elevated temperatures.

Spine adhesive band 14 should have a relatively low viscosity at the application temperature recommended by the adhesive manufacturer. The viscosity is preferably less than 10,000 centipoise (cps) with a viscosity of less than 6,000 cps being preferred. The adhesive should also be somewhat flexible or resilient at room temperature. A heat-activated adhesive manufactured by H. B. Fuller Company of St. Paul, Minn., which is designated by product No. HM-1330 and which is commonly used in book binding applications, has been found suitable for the present application. This adhesive, which has a synthetic resin base, has a viscosity of 4,800 cps at the 350° F. application temperature recommended by the manufacturer.

Cover adhesive bands 16 should have a relatively high viscosity at the application temperature recommended by the adhesive manufacturer. The viscosity of the cover adhesive should be at least 20,000 cps with a viscosity of at least 50,000 cps being preferred. A heat-activated adhesive manufactured by B. F. Goodrich Company of Akron, Ohio designated by the trademark PLASTILOCK 810 has been found suitable for this application. This adhesive has an ethylene vinyl acetate base and has a viscosity of 140,000 cps at the 350° application temperature recommended by the manufacturer.

The spine and cover adhesive bands 14 and 16 are applied to substrate 12 in a molten state using conventional hot melt adhesive dispensing equipment. If substrate 12 is fabricated from an uncoated heavy paper stock, the adhesive bands can be applied directly to the substrate without preparation. If the substrate contains some moisture, it may be necessary to heat the substrate to drive the moisture out prior to application of the adhesives.

The width of the spine adhesive band 14 should be at least equal to the thickness of the stack of pages or sheets to be bound. Adhesive strips having varying spine adhesive band widths can be provided to accommodate varying thicknesses of page stacks. The thickness of the spine adhesive, designated by the letter A in FIG. 2, should be great enough to ensure that a sufficient quantity of adhesive is available to be drawn up between the pages to be bound in order to bind the pages together. In addition, a sufficient amount of adhesive should remain between the edges of the bound pages and the substrate so that the substrate is also bonded to the edges of the pages, thereby greatly increasing the strength of the binding. A spine adhesive band 14 average thickness of at least 0.20 mm has been found to be acceptable, although it is preferred that the average thickness be approximately 0.40 mm.

The width of the two cover adhesive bands 16 should be at least approximately 1.50 mm and preferably between 3.0 to 4.0 mm. It is preferable that the average thickness of bands 16, designated by the letter B in FIG. 2, be at least one-half the thickness of the spine adhesive band 14 and preferably approximately the same thickness. Thus, if the spine adhesive band is 0.40 mm in thickness, the cover adhesive bands should also be at least approximately 0.20 mm and preferably at least approximately 0.40 mm thick. As previously noted, the prior art dual adhesive binding strips utilized a very thin cover adhesive which was typically on the order of 0.05 mm in thickness. As will be subsequently described, the high viscosity cover adhesive bands 16 of the disclosed binder strips are relatively thick in comparison to the spine adhesive band in view of the prior art and act as a gasket or seal so as to contain the low viscosity spine glue and prevent the spine glue from running over the cover glue and onto the cover sheets.

The cover adhesive bands 16 are preferably spaced-apart from the spine adhesive band 14 to form a pair of inner gaps having a width designated by the letter D in FIG. 2. An inner gap width of at least 0.5 mm is preferred. In addition, bands 16 should be spaced-apart from the edges of the substrate a minimum distance as designated by the letter C in FIG. 2 so as to form an edge gap 17 between the bands and the respective edges of the substrate 12. The presence of the edge gaps greatly improves the operation of the disclosed binder strip. Although the relatively thick cover adhesive bands 16, in comparison to the prior art, serve to contain the low viscosity spine adhesive the thick cover adhesive does not possess a sufficiently high degree of tackiness because of the relatively low cohesive strength of the molten adhesive. This lack of tackiness sometimes prevents substrate 12 from adhering to the cover sheets during the binding process. As will be subsequently described, it has been found that a gap between the cover adhesive bands 16 and the edges of the substrate promotes the flow or spreading of the high viscosity adhesive into the gap during the binding process. The thin layers of molten adhesive formed in the region of the edge gaps 17 possess a much higher degree of tackiness than a relatively thick layer of molten adhesive. Accordingly, the substrate will remain secured to the cover sheets during the bonding process. Of course, edge gaps 17 may be deleted in the event a high viscosity adhesive is used which provides a significant degree of adhesion even when molten and relatively thick.

The width D of edge gaps 17 should be adjusted in accordance with the thickness B of the cover adhesive bands 16. For very thin adhesive bands on the order of 0.1 mm or less, the gap may be deleted inasmuch as the cover adhesive will usually possess a satisfactory degree of tackiness when molten at this thickness. However, such thin bands will not provide an adequate barrier to contain the molten low viscosity spine adhesive. For adhesive bands 16 thicker than approximately 0.1 mm, the width C of gaps 17 should be at least equal to the thickness B of the bands to provide improved performance. It is preferred that width C be at least twice the thickness B of the band.

Referring now to FIGS. 3A–3H, the sequence for binding a stack of sheets utilizing the subject binder strip will now be described. There is commercially available binder apparatus which is suitable for this purpose, including, for example, a binder machine marketed by Cheshire of Murdelein, Ill. under the trademark "Cheshire 750."

The basic components of an exemplary binder machine may be seen in schematic form in FIG. 3A. The machine includes a pair of moveable opposing clamps 18 shown in the open position. Clamps 18 are positioned above a jogging plate 20 which is also moveable. Positioned below plate 20 are a pair of moveable metal jaws 22. Finally, disposed below jaws 22 is a platen or bottom plate 24. Jaws 22 and bottom plate 24 include heating elements (not shown) which heat the jaws and plates to a temperature on the order of 350° F.

Figure 3B:
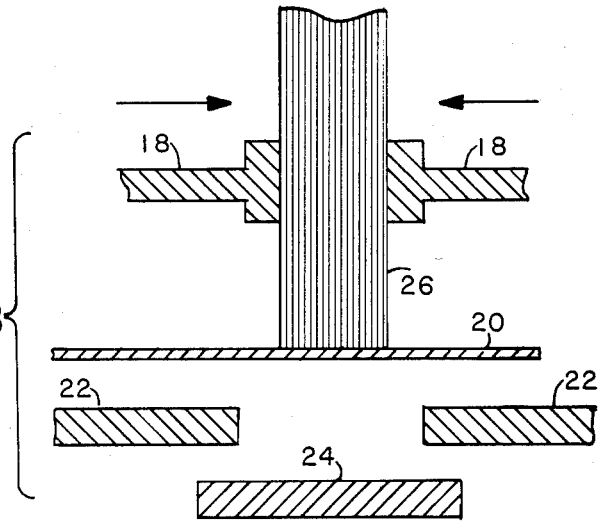

FIG. 3B illustrates the first step of the binding sequence. The sheets to be bound are formed in a stack, generally designated by the numeral 26. The first and last pages of stack 26 will form the cover sheets of the final bound volume. Clear plastic sheets, heavy paper sheets, or sheets similar to the sheets to be bound may be used for this purpose.

Stack 26 is first positioned over jogging plate 20 with the edge of the stack to be bound positioned adjacent the plate. Each sheet of the stack should preferably be resting on the plate although a strong bond can be achieved even if one or more sheets are slightly displaced.

Figure 3C:
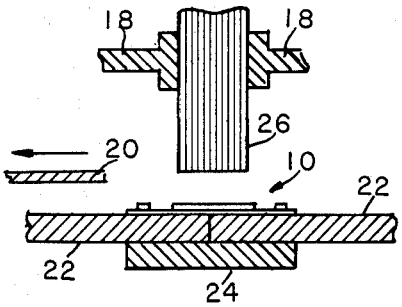
Figure 3D:
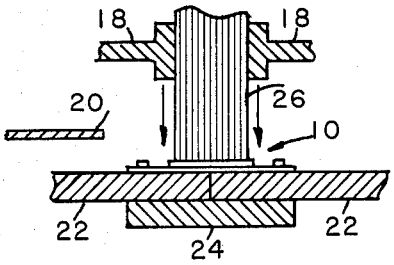

Activation of the appropriate switch (not shown) of the binder apparatus initiates the binding sequence. Following activation, clamps 18 are driven together so as to firmly grip stack 26. Referring to FIG. 3C, the jogging plate is moved away from stack 26 with the stack being supported by clamps 18. In addition, jaws 22 are merged together to form a heated surface for receiving a length of the subject binder strip 10 with the adhesive bands facing stack 26. Some binder machines automatically dispense a length of binding strip from a roll contained within the machine and include apparatus for automatically cutting the strip to the required length. Other binder machines require that the binder strip be pre-cut and manually inserted. The heat of jaws 22 causes the adhesive bands of the strip to become molten. As shown in FIG. 3D, clamps 18 lower stack 26 onto the binder strip with the edge of the stack being positioned over the spine adhesive band. Some of the low viscosity spine adhesive is drawn up between the individual sheets at this time.

Figure 3E:
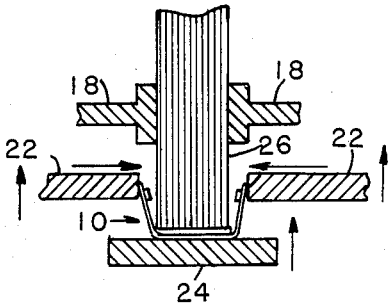

Jaws 22 then separate forming a gap between the opposing faces of the jaws which is somewhat wider than the thickness of stack 26. The binder machine is provided with internal apparatus (not shown) for automatically controlling the size of the gap in accordance with the distance between clamps 18 which corresponds to the thickness of the stack. As can be seen in FIG. 3E, jaws 22 are then driven vertically, thereby causing the edges of strip 10 to fold around stack 26. Jaws 22 are positioned with respect to binder strip 10 so that the edges of the strip contact the faces of the jaws approximately midway between the top and bottom of the faces. The actual elevation of jaws 22 will depend on the width of stack 26 and the thickness of binder strip 10. The binder machine is provided with internal apparatus (not shown) for automatically adjusting the elevation to compensate for varying stack and binder strip widths. As also shown in FIG. 3E, heated bottom plate 24 is driven upward until it contacts the bottom of binding strip 10.

Figure 3F:
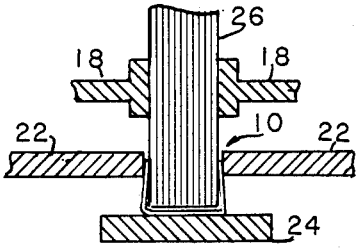

Referring now to FIG. 3F, once jaws 22 are at the proper elevation, the jaws move together forcing the edges of binding strip 10 against the front and rear cover sheets of stack 26. The heat of jaws 22 causes the cover adhesive bands to become molten. The pressure exerted by jaws 22 causes the high viscosity cover adhesive to spread into the edge gaps 17 (FIG. 2) along the edges of strip 10 and into other areas. The portion of the molten cover adhesive in the area of the gap is relatively thin and provides a sufficiently strong bond between the substrate 12 of the strip and the cover sheets to hold the two together throughout the binding sequence.

Figure 3G:
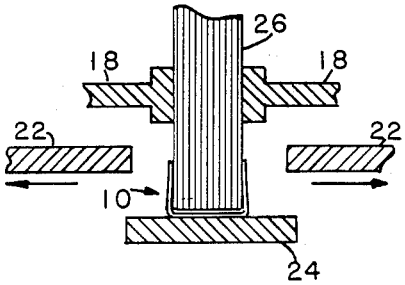

After jaws 22 have applied heat and pressure to the binder strip for approixmately five seconds the jaws are withdrawn as shown in FIG. 3G. Bottom plate 24 remains in contact with the lower surface of the strip for approximately ten additional seconds. The heat produced by plate 24 causes an additional quantity of the molten low viscosity spine glue to wick up between the individual sheets of the stack a short distance, thereby bonding the pages together and to substrate 12 of the strip.

Figure 3H:
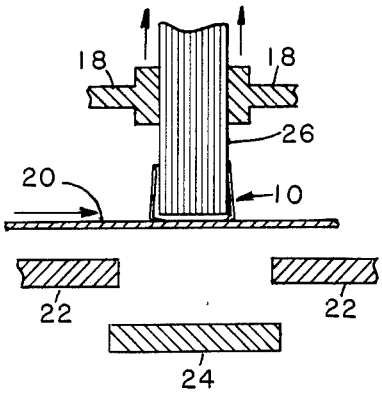

FIG. 3H shows the final step of the sequence where the bound volume is lifted by clamps 18 and jogging plate 20 is returned to the original position. Clamps 18 are then withdrawn slightly so that the bound volume is resting on the jogging plate. The volume is then removed from the binder machine.

Referring now to FIG. 4, some of the details of the final bound volume may be seen (not shown to scale). The spine adhesive 28 formed from the spine adhesive band 14 extends across the full width of the edge of the bound stack of sheets and a short distance up the two cover sheets. A significant quantity of the spine adhesive 28 is also disposed between the individual sheets, thereby binding the sheets together. The portion of the spine adhesive disposed between the edges of the sheets and substrate 12 ensures that the sheets are bonded to the substrate so that the substrate can function to reinforce the bind.

The cover adhesive 30 formed from the cover adhesive band 16 extends along the cover sheets of stack 26 from the periphery of the spine adhesive 28 up to the edge of substrate 12. The portion of the cover adhesive 30 adjacent the spine adhesive 28 is relatively thick, thereby avoiding the presence of an unsightly ridge at the two junctures of the spine and cover adhesives which is sometimes present in bound volumes using prior art binding strips.

FIG. 4 also shows that the cover adhesive band 16 which is relatively thick in view of the prior art, prevented the low viscosity, watery molten spine adhesive from flowing over the cover adhesive during the binding process. Thus, the cover adhesive is not contaminated with the spine adhesive so that a strong bond is achieved between substrate 12 and the cover sheets.

The portion of cover adhesive 30 which was formed in the region of edge gaps 17 during the binding process is relatively thin. This thin section of adhesive, when molten, possesses sufficient adhesiveness to maintain the substrate in contact with the cover sheets until the binding sequence is completed and the adhesive is cooled. The presence of edge gaps 17 between the edges of substrate 12 and the cover adhesive bands greatly promotes the formation of this thin layer of adhesive.

The efficacy of maintaining a gap of adequate width between the edge of the substrate and the cover adhesive bands was verified through testing. Several test binding strips were fabricated having a cover adhesive band 16 made of the previously-noted high viscosity Plastilock 810 brand adhesive. The thickness of band 16 was maintained at 0.30 mm with the widths of the edge gaps varying from no gap at all to gaps of approximately 0.40 mm, 0.80 mm and 1.60 mm in width. The binding strips were then tested utilizing a binder apparatus of the type depicted schematically in FIGS. 3A–3H.

Almost all of the binding strips having no gaps or gaps of 0.80 mm or less produced defective binds. In some instances, the substrate was completely separated from the cover sheets in some areas. In other instances, the edges of the substrate had slipped down the cover sheets a significant distance leaving a quantity of unsightly adhesive exposed on the cover sheets. When this occurred, the central portion of the substrate was frequently separated or spaced apart from the edges of the bound sheets, thereby greatly reducing the strength of the bind.

The defective binds were the result of inadequate adhesion between the cover sheets and the substrate during the course of the binding process. As shown in FIG. 3F, jaws 22 of the binder apparatus apply pressure and heat to the substrate adjacent the cover adhesive bands 10. The molten cover adhesive must provide sufficient adhesion at this point to maintain the edges of the strip in contact with the cover sheet. If the layer of molten cover adhesive is too thick, the requisite adhesiveness will not be present; therefore the edges of the strip are likely to detach from the cover sheets when jaws 22 are withdrawn as shown in FIG. 3G. Alternatively, when the bound volume is lifted off of bottom plate 24, the entire strip may shift downwardly leaving a trail of cover adhesive exposed on the cover sheets and causing the central portion of substrate 12 to separate from the edges of stack 26.

Tests using binding strips utilizing Plastilock 810 brand cover adhesives of thickness of less than and greater than 0.30 mm produced similar results, it being observed that very thin cover adhesive bands do not require the gap and somewhat thicker bands require larger gaps. Tests were also conducted using cover adhesives having viscosities somewhat lower than that of the Plastilock 810. These tests indicated that lower viscosity adhesives generally require a greater gap width in comparison to the thickness of the cover adhesive bands to ensure a satisfactory bind. It is believed that the converse would be applicable for adhesives having viscosities even greater than that of the Plastilock brand adhesive and that the width of the gaps could be reduced somewhat.

A test was also performed to demonstrate the efficacy of maintaining a cover adhesive band which is relatively thick in comparison to the spine adhesive band in view of the prior art. A substrate was prepared having a uniform coating of low viscosity cover adhesive which was on the order of 0.05 mm in thickness. A spine adhesive band, similar to band 14 of the disclosed binding strip, was laid over the cover adhesive along the central portion of the substrate, leaving two strips of the cover adhesive exposed along the edges of the substrate. The spine adhesive band was approximately 0.4 mm thick and was fabricated from a low viscosity adhesive (2,000 cps at the application temperature). Of the three strips tested, one failed to produce a satisfactory bind in that the molten low viscosity spine adhesive flowed over and contaminated the thin layer of cover adhesive. In contradistinction, a similar low viscosity spine adhesive was successfully employed in binding strips of the type disclosed herein which utilize relatively thick cover adhesive bands.

Thus, a novel binding strip has been disclosed. While a preferred embodiment of the subject invention has been described in some detail, it is apparent that a person of ordinary skill could make obvious modifications thereto without departing from the spirit and scope of the subject invention as defined by the appended claims.

What is claimed is:

1. A device for binding pages together comprising:

an elongated substrate of formable material;

a first adhesive band disposed on said substrate along a longitudinal axis thereof, said first adhesive band comprising a heat-activated relatively low viscosity adhesive; and second and third adhesive bands disposed on said substrate on opposite sides of said first adhesive band, said second and third adhesive bands comprising a heat-activated relatively high viscosity adhesive and having a thickness which is at least one-half the thickness of said first adhesive band.

2. The device of claim 1 wherein said second and third adhesive bands are spaced apart from longitudinal edges of said substrate to form a pair of edge gaps, said edge gaps having a width at least as great as the thickness of said second and third bands.

3. The device of claim 2 wherein said edge gaps have a width at least as great as twice the thickness of said second and third bands.

4. The device of claim 3 wherein said low viscosity adhesive has a viscosity of less than 10,000 centipoise at an application temperature of said low viscosity adhesive.

5. The device of claim 4 wherein said low viscosity adhesive has a viscosity of less than 6,000 centipoise at said low viscosity application temperature.

6. The device of claim 4 wherein said high viscosity adhesive has a viscosity of at least 20,000 centipoise at an application temperature of said high viscosity adhesive.

7. The device of claim 6 wherein said high viscosity adhesive has a viscosity of at least 50,000 centipoise at the application temperature of high viscosity adhesive.

8. The device of claim 6 wherein said second and third adhesive bands are spaced apart from said first adhesive band so as to form a pair of center gaps between said second and third adhesive bands and said first adhesive band.

9. The device of claim 8 wherein said thickness of said second and third adhesive bands is at least 0.30 mm.

10. A device for binding pages together comprising:

an elongated substrate of formable material;

a first adhesive band disposed on said substrate along a longitudinal axis thereof, said first adhesive band comprising a heat-activated, low viscosity adhesive having a viscosity of less than 10,000 centipoise at the application temperature of the low viscosity adhesive; and second and third adhesive bands disposed on said substrate on opposite sides of said first adhesive band having a thickness at least one-half the thickness of said first adhesive band, said second and third adhesive bands being spaced apart from longitudinal edges of said substrate to form a pair of edge gaps having a width at least as great as twice the thickness of said second and third bands, said second and third adhesive bands comprising a heat-activated high viscosity adhesive having a viscosity of at least 20,000 centipoise at the application temperature of the high viscosity adhesive.

* * * * *